United States Patent [19]

Liebetrau

[11] Patent Number: 4,896,473

[45] Date of Patent: Jan. 30, 1990

[54] METHOD OF CONVERTING TO A SECURITY GLAZING SYSTEM

[76] Inventor: Richard E. Liebetrau, 237 Petrie Rd., Cadillac, Mich. 49601

[21] Appl. No.: 335,440

[22] Filed: Apr. 10, 1989

Related U.S. Application Data

[63] Continuation of Ser. No. 166,691, Mar. 14, 1988, abandoned, which is a continuation-in-part of Ser. No. 938,320, Dec. 5, 1986, abandoned.

[51] Int. Cl.[4] ..... E06B 5/10

[52] U.S. Cl. ..... 52/747; 52/235; 52/400; 52/464; 109/79

[58] Field of Search ..... 52/235, 747, 400, 204, 52/398, 461, 464, 468; 109/58, 78, 79, 80, 85

[56] References Cited

U.S. PATENT DOCUMENTS

| | | | |
|---|---|---|---|
| 3,052,330 | 9/1962 | Hammitt | 52/235 |
| 3,267,318 | 8/1966 | Hammitt | 52/400 |
| 3,488,906 | 1/1970 | Brooks | 52/235 |
| 3,734,550 | 5/1973 | Vance | 52/235 |
| 4,321,777 | 3/1982 | Sauret | 52/308 |
| 4,625,659 | 12/1986 | Saelzer | 52/204 |

*Primary Examiner*—John E. Murtagh

*Attorney, Agent, or Firm*—Bachman & LaPointe

[57] ABSTRACT

A system to provide security from forced entry or from ballistic missiles and for converting an existing non-secure glazing system into a secure glazing system where the conversion occurs at the exterior of the wall enclosure without disturbing the interior of the enclosure, or any of the originally installed main framing.

4 Claims, 3 Drawing Sheets

METHOD OF CONVERTING TO A SECURITY GLAZING SYSTEM

RELATED APPLICATION

This is a continuation of application Ser. No. 166,691 filed Mar. 14, 1988, now abandoned which in turn is a continuation-in-part of application Ser. No. 938,320, entitled Security Glazing System, filed Dec. 5, 1986, by R. E. Liebetrau now abandoned.

BACKGROUND OF THE INVENTION

The present invention relates to glazing systems such as storefronts, curtainwalls, etc. and in particular to such walls which include horizontal and vertical frames supporting large panels of rigid material.

Usually such walls are glazed and include mullions and base plates which receive and support glass panels with suitable flexible gaskets surrounding the glass panels to make a water tight seal between the supporting frames and the glass panels.

Invariably these curtain walls are designed for a particular glazing assembly or glazing package having fixed dimensions for a relatively permanent installation.

In addition, these glazing installations are designed usually to support loads generated by ordinary storefront plate glass and do not include adequate structure to support much heavier loads such as are generated by bullet resistant glazing assemblies.

That is, no change in the design or configuration of the curtain wall structure is contemplated other than the replacement of defective gaskets and broken glass panels, as the case may be.

Prior art patents pertinent to the disclosure over which the present invention is an improvement are U.S. Pat. Nos. 3,380,210, 3,638,385 and 4,625,659.

While the '210 reference discloses a filler piece 72, the frame structure is not of sufficient strength to support bullet resistant glazing assemblies and the frame, in general, is not secure from ballastic projectiles.

While the '659 reference discloses a security window or door structure, there is a substantial opening about the periphery of the channel frame which provides access for deflected projectiles entering through the ventilation gap 12. The '659 concept incorporates a pressure equalization chamber for absorbing explosive energy. The system is designed for a single original installation with no provision for modification or retrofilting.

SUMMARY OF THE INVENTION

In contrast, it is a principal object of the present invention to provide a glazing system surrounding an enclosure where certain elements of the structure are so designed as to facilitate the accommodation of a variety of panel assemblies, i.e. panel assemblies of a variety of cross-sectional thicknesses.

It is a further feature of the invention to provide a glazing system which can be converted after original installation from one existing panel assembly of a given cross-sectional thickness to another panel assembly of different cross-sectional thickness without disturbing the interior of the enclosure about which the glazing system is erected, or without removing any of the original main framing.

A still further feature of the invention is the provision of a storefront or curtainwall system which provides sufficient support for glazing material whose weight per unit volume is nearly 4 times the corresponding weight of ordinary plate glass.

A still further feature of the invention is the provision of a glazing support or frame structure which if glazed initially with ordinary non-secure plate glass panels is of sufficient load bearing capacity to accept and support replacement secure panels without the necessity to rebuild or strengthen the support structure.

A still further feature of the invention is the provision of a curtain wall system which in the first instance accommodates a conventional non-secure wall panel package (susceptible of breach by projectiles or other powder actuated missiles) which is readily convertible to a secure wall panel package (one that is bullet and forced entry resistant) where the conversion is accomplished entirely from the exterior of curtain wall enclosure.

A further feature of the invention is the provision of a conversion "kit" which facilitates the conversion of an existing assembly from a non-secure condition to a secure condition, by changing the security configuration without removing the main framing originally installed.

A further feature of the invention is the provision of a method of devising a glazing system which lends itself to conversion from an existing glazing assembly of a given cross-sectional thickness to one of a plurality of glazing assemblies each of a different cross-sectional thickness.

A still further feature of the invention is the provision of a novel mullion structure for a glazing system which is operable to receive and support on one side a panel assembly of a first cross-sectional thickness and to receive on an opposite side a panel assembly of a second different cross-sectional thickness.

A further feature of the invention is the provision of a mullion device having a channel structure with separable inner and outer sidewalls.

A still further feature of the invention is the provision of a mullion device having opposed channels which includes a rigid filler element which is operable to change the cross-sectional dimension of one channel relative to the corresponding cross-sectional dimension of the other of said opposed channels.

A still further feature of the system is the provision of heavy framing, so that all voids between the bullet resisting glazing materials are protected or backed by bullet resisting framing materials.

A further feature of the invention is the provision of a rigid, removable filler element which extends throughout the edge margins or periphery of the glazing panels operable to complement the cross-sectional thickness of a glazing assembly.

A still further feature of the invention is the provision of an exterior bullet resistant frame structure between adjacent bullet resistant glazing panels thereby precluding the need for ballistic packing in the interior of the frame structure.

A further feature of the invention is the provision of a combined glazing and frame structure operable to repel projectiles whose trajectory, while generally horizontal, approaches the panel and/or frame structure along an oblique path.

A mullion device embracing certain principles of the present invention may comprise a frame structure having horizontal and vertical members for supporting glazing having a weight ranging from 3.2 to 12.6 pounds per square foot and at least one vertical channel having separable inner and outer sidewalls spaced apart by a predetermined cross-sectional dimension to receive a glazing assembly having a thickness mating with said dimension, removable fastening means for securing said outer sidewall to said vertical member, a portion of said vertical member defining said inner sidewall, and rigid filler means in contact with one of said inner and outer sidewalls effective to reduce said dimension so that said one vertical channel is operable to receive a glazing assembly of a thickness less than said predetermined dimension.

A conversion kit embracing certain other principles of the invention may comprise a unitary piece part defining a pair of spaced legs connected by a bridge, each leg terminating in a channel sidewall so that a leg and its contigous sidewall define an L-shape, fastening means for securing the bridge to a vertical member and a bullet resistant cover coextensive vertically with said piece part for engaging the spaced legs and for closing the gap between legs.

Other features and advantages of the present invention will become more apparent from an examination of the succeeding specification when read in conjunction with the appended drawings, in which;

DETAILED DESCRIPTION OF THE DRAWINGS

DETAILED DESCRIPTION OF THE PREFERRED EMBODIMENTS

Figure 1:
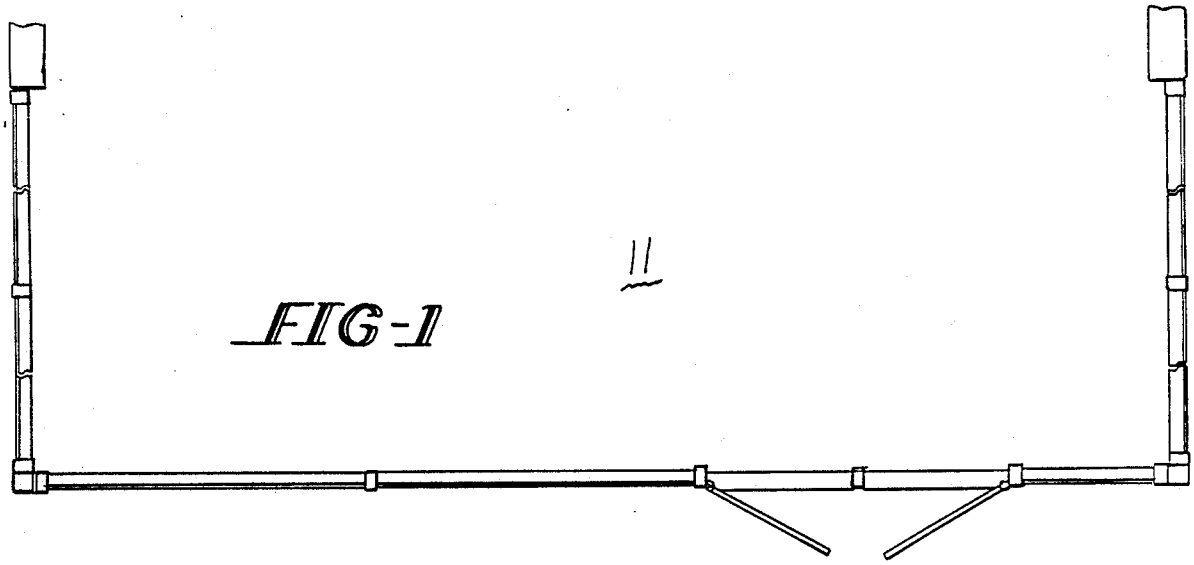
FIG. 1 is a plan view of a typical enclosure to which the principles of the present invention are applied.
Figure 2:
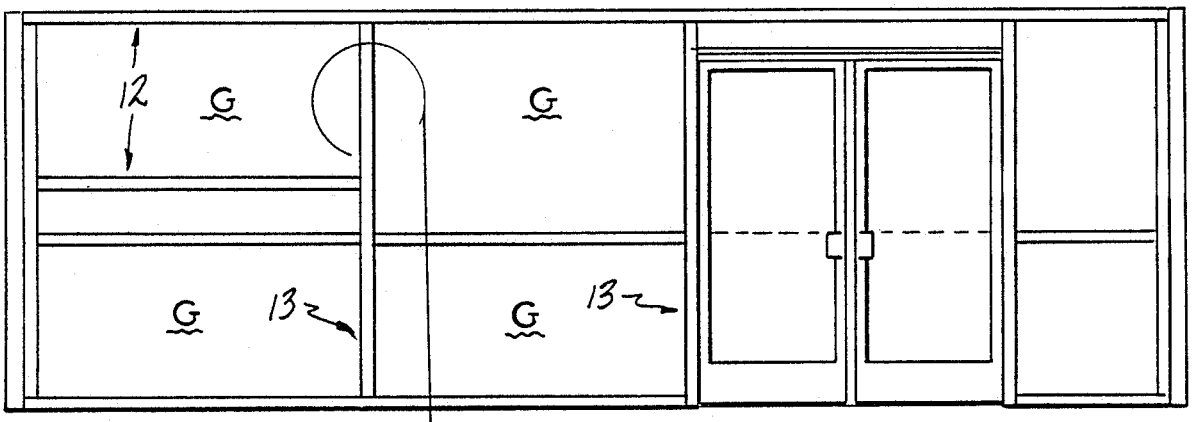
FIG. 2 is a front elevation of the disclosure of FIG. 1.

Referring in detail to the drawings the reference numeral 11 designates an enclosure developed by a fixed frame structure including horizontal and vertical members 12 and 13, respectively.

The enclosure is completed by glazing assemblies G which comprise one or more panels of glazing materials supported in the frame members with appropriate gaskets to make the unit weather tight.

In order to facilitate transition from one glazing assembly to another, performing all work on the exterior of the enclosure without disturbing personnel or material within the enclosure, a novel mullion device M is provided in combination with a vertical member 13 of the enclosure 11.

Figure 3:
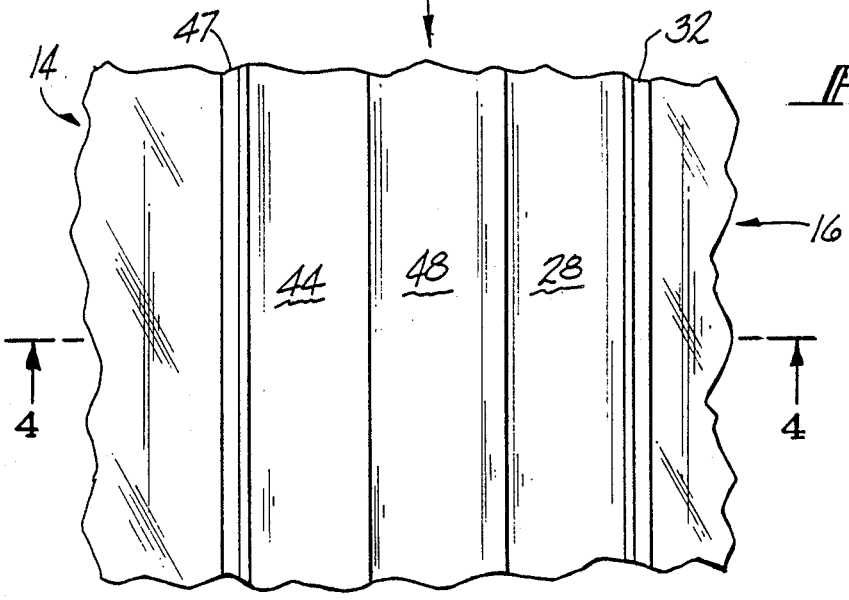
FIG. 3 is an enlarged view of a portion of the mullion device of the present invention associated with a vertical member of the fixed frame structure of FIGS. 1 and 2.
Figure 4:
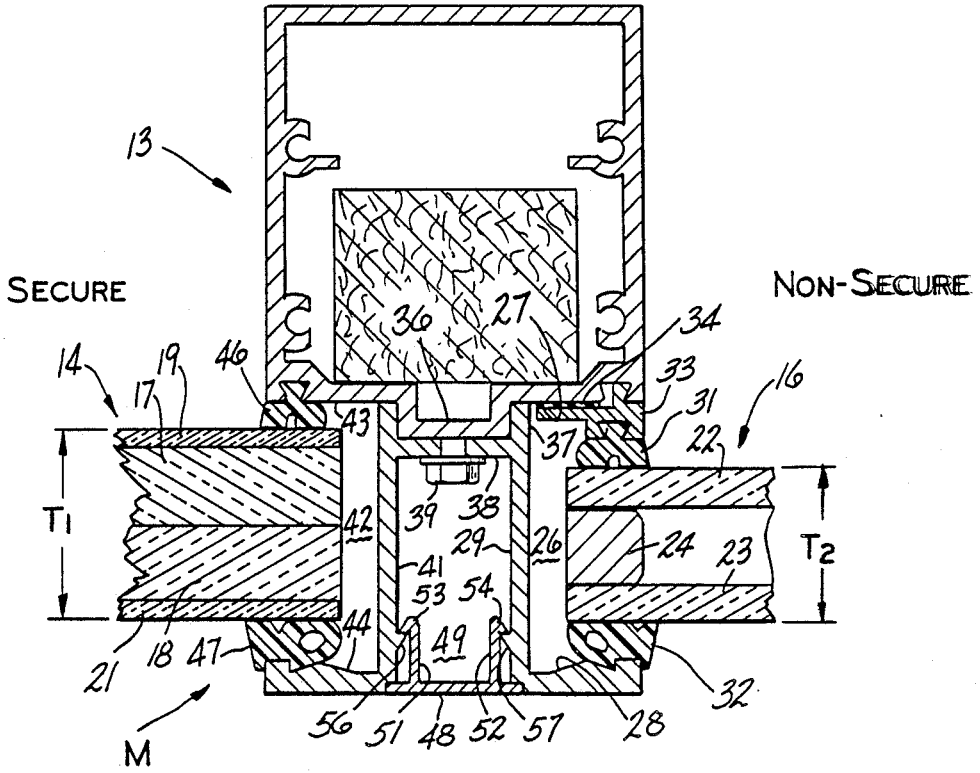
FIG. 4 through 8 show various transitions of glazing assemblies, non-secure to secure, including appropriate filler elements.
Figure 5:
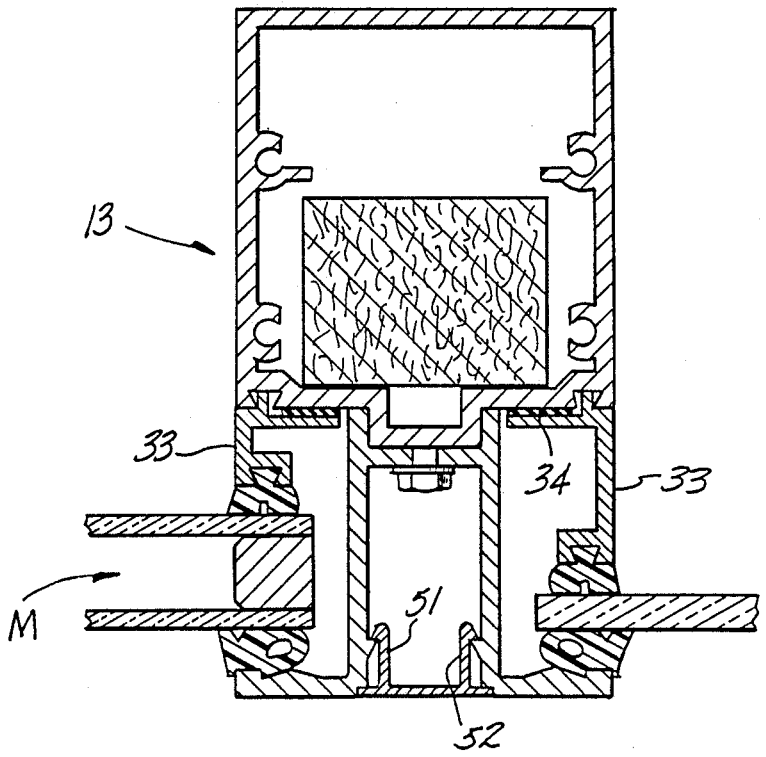

Referring in detail to FIGS. 3 and 4 a mullion device M is shown secured to a vertical member 13 receiving at the left side a glazing assembly 14 of cross-sectional thickness $T_1$ making a transition to receive at the right side to a glazing assembly 16 having a smaller cross-sectional thickness $T_2$.

For reasons which will become more apparent as the specification proceeds the glazing assembly 14 is termed a "secure" assembly and the glazing assembly 16 is termed "non-secure".

The secure assembly 14 includes typically bullet resisting glazing materials not necessarily limited to glass but may include laminated sheets or assemblies of glass, polycarbonates, metals and other resinous materials as security risks dictate. The secure assemblies may be transparant or opaque.

In the embodiment disclosed in FIG. 4 the secure assembly 14 includes inner plates 17 and 18 clad with outer plates 19 and 21 all fabricated of polycarbonate resin compounds.

The non-secure glazing assembly 16 comprises ordinary glazing materials 22 and 23.

The sills supporting the glazing assemblies are of sufficient structural integrity to support heavy glazing assemblies ranging in weight from 3.2 to 12.6 pounds per square foot of glazing material whereby non-secure glazing installations may be replaced by secure installation without the necessity to rebuild or strengthen the load bearing sills.

As shown in FIG. 4 the mullion device M cooperates with vertical member 13 in that a vertical channel 26 defined by an inner sidewall 27 and a separable outer sidewall 28 provide a receptacle for glazing assembly 16.

Note that the inner sidewall 27 of channel 26 defines a planar surface of vertical member 13 while the outer sidewall 28 is connected to a leg 29 to define an L-shape.

Glazing assembly 16 having a thickness $T_2$ plus conventional peripheral gaskets 31 and 32 does not create a "pile up" sufficient to fill the channel 26. Consequently, a rigid filler element 33, coextensive with inner sidewall 27 and held in place by spaced segments of adhesive means 34, is inserted to fill out the required pile up.

The filler element 33 extends vertically and horizontally about the perimeter or edge margin of the non-secure glazing assembly 16.

The vertical member 13 is formed with a rib 36 against which a projection 37 of leg 29 bears as it is bottomed on inner sidewall 27.

The leg 29 includes a bridge 38 and fastening means in the form of a machine screw 39 which makes a connection with the rib 36 to secure leg 29 to vertical member 13.

While leg 29 is shown connected to and spaced from a similar leg 41 by bridge 38 it is entirely within the contemplation of the invention to fabricate each leg as separate piece parts with individual fastening means connecting bridge portions to the rib 36.

It is preferable that the legs 29 and 41 be joined by bridge 38 to define a single piece part to facilitate changing glazing assemblies as will be more apparent hereinafter.

For purposes of claiming the invention the unitary piece part having joined legs 29 and 41 is referred to as a removable glazing clip.

Leg 41 bounds channel 42 having an inner sidewall 43 and outer sidewall 44. The glazing assembly 14 having thickness $T_1$ plus gaskets 46 and 47 adequately fill the cross-sectional dimension of channel 42 without the need for a filler element.

An elongated cover 48 closes the gap 49 that exists between legs 29 and 41. The cover includes flexible projections 51 and 52 terminating in eared tabs 53 and 54 which effect a camming action while overriding and interlocking with mating lugs 56 and 57 from on the legs 29 and 41, respectively, to secure the cover.

The cover may be structured in a continuous fashion as an extrusion or consist of a plurality of contiguous cover segments, as desired.

Figure 9:
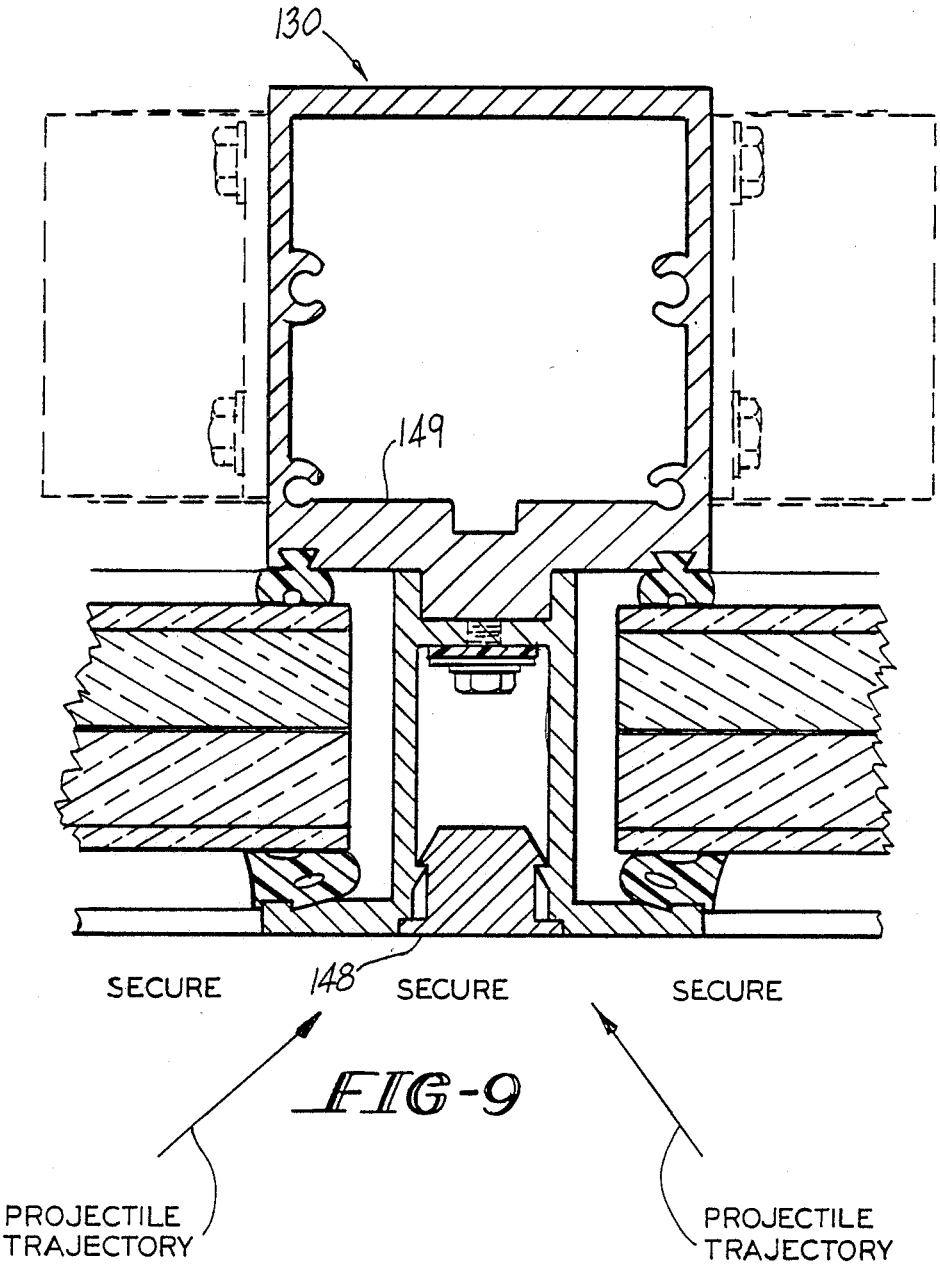
FIG. 9 is an alternative embodiment of a secure mullion device.

In the alternative embodiment shown in FIG. 9 the cover 148 is a solid bar which interlocks with legs 29 and 41 in the fashion previously described.

In the FIG. 9 arrangement the cover 148 provides bullet resistant protection "backed up" by a thickened wall 149 on the vertical member 130.

In this fashion the mullion M of FIG. 9 provides a bullet resistant joint between bullet resistant glazing panels without the need to resort to expensive packing material such as is shown at B in FIGS. 4 through 8.

Furthermore, the modification illustrated in FIG. 9 provides protection against projectiles and other missiles impacting the wall structure at oblique angles as shown by the arrows and legends in FIG. 9.

In addition, the bullet resistant wall 149 provides additional ballistic security in situations where, through human error, packing material B (FIG. 6) is not present.

Obviously, the elimination of the ballistic packing B and its replacement with bullet resistant cover 148 and bullet resistant wall 149 reduces labor costs and eliminates the cost of the packing material as well.

A further consideration, which the glazing system of the present invention anticipates, is the size limitations of ballistic glazing relative to conventional glazing sizes.

Transparent ballistic glazing costs of the order of 30 times the cost of conventional ¼ inch plate glass and stock sizes of ballistic glazing are limited. Thus, it is important that original non-secure, convertible glazing installations are designed to receive stock sizes of transparent ballistic plate to avoid extremely expensive special order ballistic plate.

Thus, the concept of the present invention includes a frame structure which is calculated to receive (in a conversion from non-secure to secure plate) stock sizes of transparent ballistic plate.

In order to change an existing non-secure glazing assembly such as the assembly 16, on the right side of FIG. 4 to a secure glazing assembly such as exists on the left side of FIG. 4 the following steps are practiced working from the outside of the enclosure:

The cover 48 (or 148) is machined to destruction by drilling, metal sawing or the like. Thereafter a suitable wrench, such as a socket wrench, is used to back off the several fastening means 30 which are spaced vertically along the bridge 38. This step releases the outer sidewalls 28 and 44 and the unitary glazing clip is removed.

Similar steps are undertaken at the opposite end (not shown) of the non-secure glazing assembly 16 to release the opposite end of the assembly.

Next the non-secure assembly 16 is removed; the filler elements 33 at the perimeter of the assembly 16 including the adhesive means 34 are also removed.

The assembly 16 is removed by lifting the assembly out of its sill and moving it into the head space or clearance provided in the upper horizontal frame member in well known fashion.

Gasket 31 (or a new one) is moved into keying relationship with inner sidewall 27 and a secure glazing assembly is moved into place.

The legs 29 and 41, as a unitary piecepart, are replaced straddling the rib 36.

Figure 6:
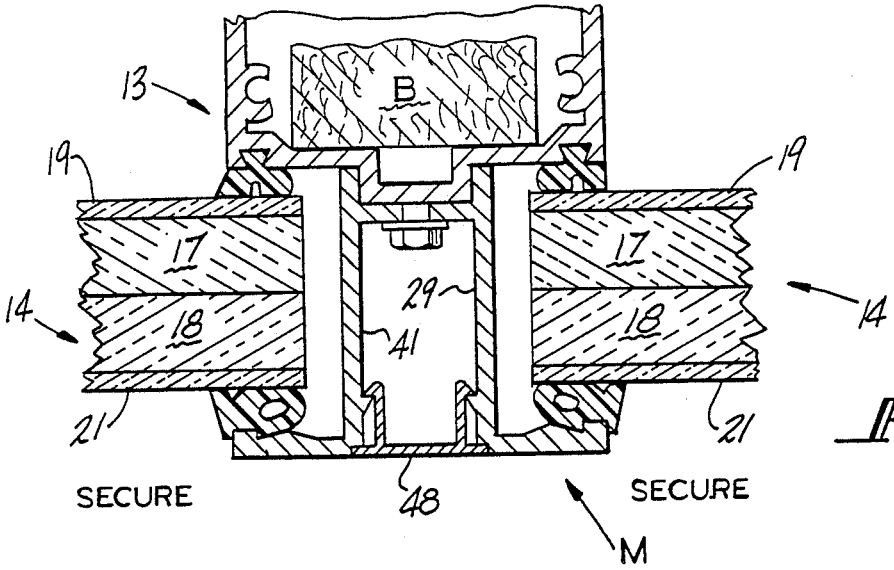
Figure 7:
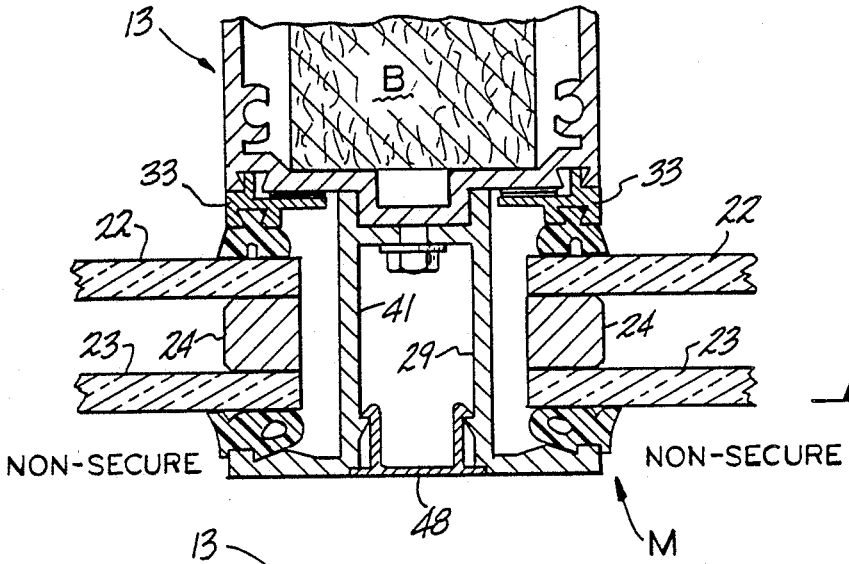

Upon setting up the fastening means 39 and installing a new cover 48 and reinstalling peripheral gasket 32, the glazing assemblies of FIG. 4 now appear as shown in FIG. 6 with secure assemblies on both sides of the mullion device M.

The language "non-secure" is intended to denote a panel or glazing assembly which will not repel bullets, similar projectiles or forced entry, while the language "secure" is intended to denote bullet repellant or bullet resistant panels or glazing assemblies, as well as assemblies to prevent forced entry.

Thus it is apparent that the present invention provides a mullion device which is operative to receive a first non-secure panel or glazing assembly in a permanent or temporary installation while lending itself to conversion to a different assembly secure or non-secure, where the assemblies may have a wide variety of thicknesses. It is merely necessary to select a filler element of appropriate dimensions to fill out the channel dimension as required.

In secure installations such as shown in FIG. 6 it is necessary to make the peripheral frame members secure as well. One way to secure the frame members is to introduce bullet resistant packing B (FIG. 6). Another way is to increase the gauge or thickness of the various horizontal and vertical extrusions comprising the frame members as shown in FIG. 9.

To effect a transition from one glazing assembly to another in the field, a kit is provided which may include new gaskets, new cover filler element consistent with the width of the channel and the thickness of the glazing assembly, or other parts needed for individual requirements.

Figure 8:
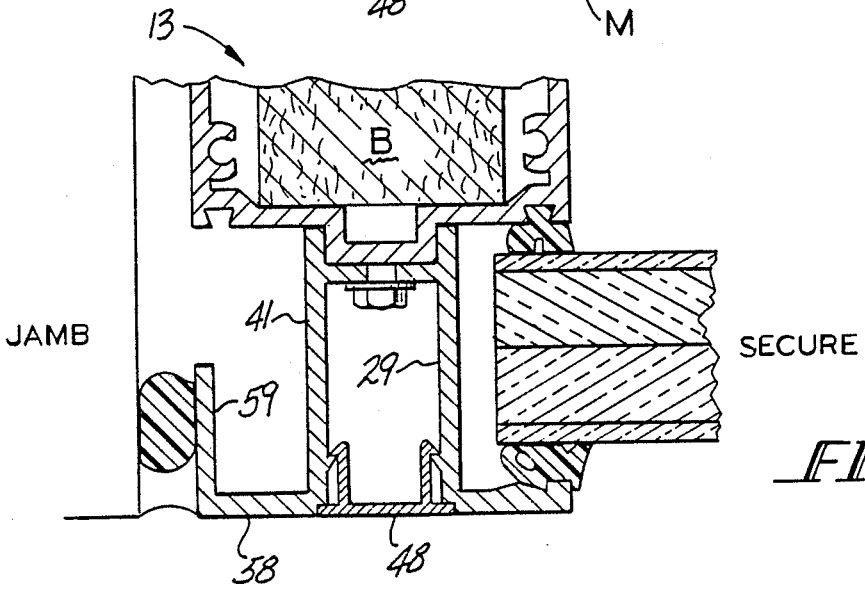

FIG. 8 shows a modified removable glazing clip in which leg 41 having outer sidewall 58 includes an endwall 59. Clips of this configuration are used next to a jamb, or wall configuration.

It is understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. In a storefront structure including glazing frames having horizontal and vertical components for supporting glazing assemblies, said glazing assemblies defining a first secure assembly having a thickness dimension $T_1$ and a second non-secure assembly having a thickness dimension $T_2$, wherein $T_2$ is less than $T_1$, said glazing frames having glazing clips for retaining said glazing assemblies, said glazing clips including a thin-walled cover means and fastening means for securing the clips to one of said components, wherein the storefront structure supports, initially, a non-secure glazing assembly plus a filler element, said filler element being operable to adjust dimension $T_2$ to the value of dimension $T_1$, a method of converting a non-secure glazing assembly to a secure glazing assembly wherein all steps are performed on the exterior or weatherside of the storefront structure comprising the sequential steps of:

removing the cover means to gain access to the fastening means, removing the fastening means to free the glazing clip, removing the glazing clip, removing the non-secure glazing assembly including the filler element, installing a secure glazing assembly replacing said glazing clip and said fastening means, and, substituting a new cover means in the form of a length of solid bar stock to render the cover means secure.

2. The method of claim 1 in which the glazing clip is secured to a vertical component of the glazing frame.

3. The method of claim 1 in which the cover means interlocks with said glazing clip.

4. The method of claim 1 in which the thin-walled cover means is removed by machining the cover means to destruction.

* * * * *